US011306557B2

(12) United States Patent
Murphy et al.

(10) Patent No.: US 11,306,557 B2
(45) Date of Patent: Apr. 19, 2022

(54) SUBSEA TREE WITH ROTATABLE PRODUCTION OUTLET

(71) Applicant: FMC Technologies, Inc., Houston, TX (US)

(72) Inventors: Richard Murphy, Houston, TX (US); Kevin McIlwaine, Edinburgh (GB)

(73) Assignee: FMC TECHNOLOGIES, INC., Houston, TX (US)

( * ) Notice: Subject to any disclaimer, the term of this patent is extended or adjusted under 35 U.S.C. 154(b) by 93 days.

(21) Appl. No.: 16/758,598

(22) PCT Filed: Oct. 23, 2018

(86) PCT No.: PCT/US2018/057052
§ 371 (c)(1),
(2) Date: Apr. 23, 2020

(87) PCT Pub. No.: WO2019/083968
PCT Pub. Date: May 2, 2019

(65) Prior Publication Data

US 2021/0180423 A1 Jun. 17, 2021

Related U.S. Application Data

(60) Provisional application No. 62/575,967, filed on Oct. 23, 2017.

(51) Int. Cl.
*E21B 33/035* (2006.01)

(52) U.S. Cl.
CPC ..... *E21B 33/035* (2013.01)

(58) Field of Classification Search
CPC ..... E21B 33/035; E21B 33/0353
See application file for complete search history.

(56) References Cited

U.S. PATENT DOCUMENTS 2,673,615 A * 3/1954 Humason ..... E21B 33/03 166/95.1
5,868,203 A * 2/1999 Cunningham ..... E21B 41/10 166/344

(Continued)

FOREIGN PATENT DOCUMENTS

GB 2358207 A 7/2001
GB 2398309 A * 8/2004 ..... E21B 33/035

OTHER PUBLICATIONS

International Search Report issued in corresponding International Application No. PCT/US2018/057052, dated Jan. 31, 2019 (3 pages).

(Continued)

*Primary Examiner* — Matthew R Buck
(74) *Attorney, Agent, or Firm* — Osha Bergman Watanabe & Burton LLP

(57) ABSTRACT

A Christmas tree may include a body and a sleeve. The body may include a production flowbore therethrough, a longitudinal flowbore intersecting the production flowbore, and optionally one or more annulus passageways, crossover passageways, or chemical injection passageways intersecting at least one of the production flowbore and the longitudinal flowbore. The sleeve may be attached to and circumferentially rotatable about at least a portion of the body and may include a transverse flowbore therethrough. An annular fluid gallery may be formed between the body and the sleeve. At least one of the longitudinal flowbore and the one or more annulus passageways, crossover passageways, or chemical injection passageways may include a flowpath connecting to the annular fluid gallery or is configured to be connected to a flowpath connecting to the annular fluid gallery.

18 Claims, 5 Drawing Sheets

(56) References Cited

U.S. PATENT DOCUMENTS

| | | | | |
|---|---|---|---|---|
| 6,209,650 | B1 * | 4/2001 | Ingebrigtsen | E21B 43/0135 166/368 |
| 6,213,215 | B1 * | 4/2001 | Breivik | E21B 7/128 166/350 |
| 6,223,825 | B1 * | 5/2001 | Ingebrigtsen | E21B 34/04 166/345 |
| 7,063,160 | B2 | 6/2006 | Fenton et al. | |
| 8,061,428 | B2 | 11/2011 | Fenton et al. | |
| 9,273,531 | B2 | 3/2016 | Tan et al. | |
| 2005/0028984 | A1 * | 2/2005 | Donald | E21B 33/076 166/368 |

OTHER PUBLICATIONS

Written Opinion issued in corresponding International Application No. PCT/US2018/057052, dated Jan. 31, 2019 (6 pages).

* cited by examiner

SUBSEA TREE WITH ROTATABLE PRODUCTION OUTLET

BACKGROUND

Production equipment is often connected to wellheads used in the production of hydrocarbons extracted from subterranean formations. Wellheads also provide support for tubing and casing inserted into the wellbore. Production equipment connected to a wellhead may include a production Christmas tree connected to the upper end of the wellhead housing. The Christmas tree controls and distributes the fluids produced from the wellbore. Valves are typically provided within Christmas trees for controlling the flow of oil or gas from a wellhead and/or for controlling circulating fluid flow in and out of a wellhead. The Christmas tree may control the flow of the hydrocarbons to production equipment disposed at a distance from the wellhead, such as a flowline hub.

Conventional Christmas trees and wellheads require that the Christmas tree be oriented after it has been deployed, such that the Christmas tree may correctly attach to the wellhead and to the distant production equipment. Other equipment associated with a wellhead and Christmas tree, such as a tubing hanger, may also have to be oriented after deployment to a subsea location. Orienting equipment such as Christmas trees and tubing hangers after they have been deployed to a subsea location may be time-consuming, inaccurate, and may risk damage to the equipment.

SUMMARY OF THE DISCLOSURE

In one aspect, this disclosure relates to a Christmas tree which may include a body and a sleeve. The body may include a production flowbore therethrough, a longitudinal flowbore intersecting the production flowbore, and optionally one or more annulus passageways, crossover passageways, or chemical injection passageways intersecting at least one of the production flowbore and the longitudinal flowbore. The sleeve may be attached to and circumferentially rotatable about at least a portion of the body and may include a transverse flowbore therethrough. An annular fluid gallery may be formed between the body and the sleeve. At least one of the longitudinal flowbore and the one or more annulus passageways, crossover passageways, or chemical injection passageways may include a flowpath connecting to the annular fluid gallery or is configured to be connected to a flowpath connecting to the annular fluid gallery.

In another aspect, this disclosure relates to an assembly which may include a wellhead having a central bore and a Christmas tree. The Christmas tree may include a body and a sleeve. The body may include a production flowbore therethrough, a longitudinal flowbore intersecting the production flowbore, and optionally one or more annulus passageways, crossover passageways, or chemical injection passageways intersecting at least one of the production flowbore and the longitudinal flowbore. The sleeve may be attached to and circumferentially rotatable about at least a portion of the body and may include a transverse flowbore therethrough. An annular fluid gallery may be formed between the body and the sleeve. At least one of the longitudinal flowbore and the one or more annulus passageways, crossover passageways, or chemical injection passageways may include a flowpath connecting to the annular fluid gallery or is configured to be connected to a flowpath connecting to the annular fluid gallery.

In another aspect, this disclosure relates to a method of installing a Christmas tree on a wellhead. The method may include the following steps: configuring the sleeve of an adapter to have an orientation, deploying the adapter to the wellhead, and connecting the adapter to the wellhead.

Other aspects and advantages will be apparent from the following description and the appended claims.

DETAILED DESCRIPTION

Figure 1A:
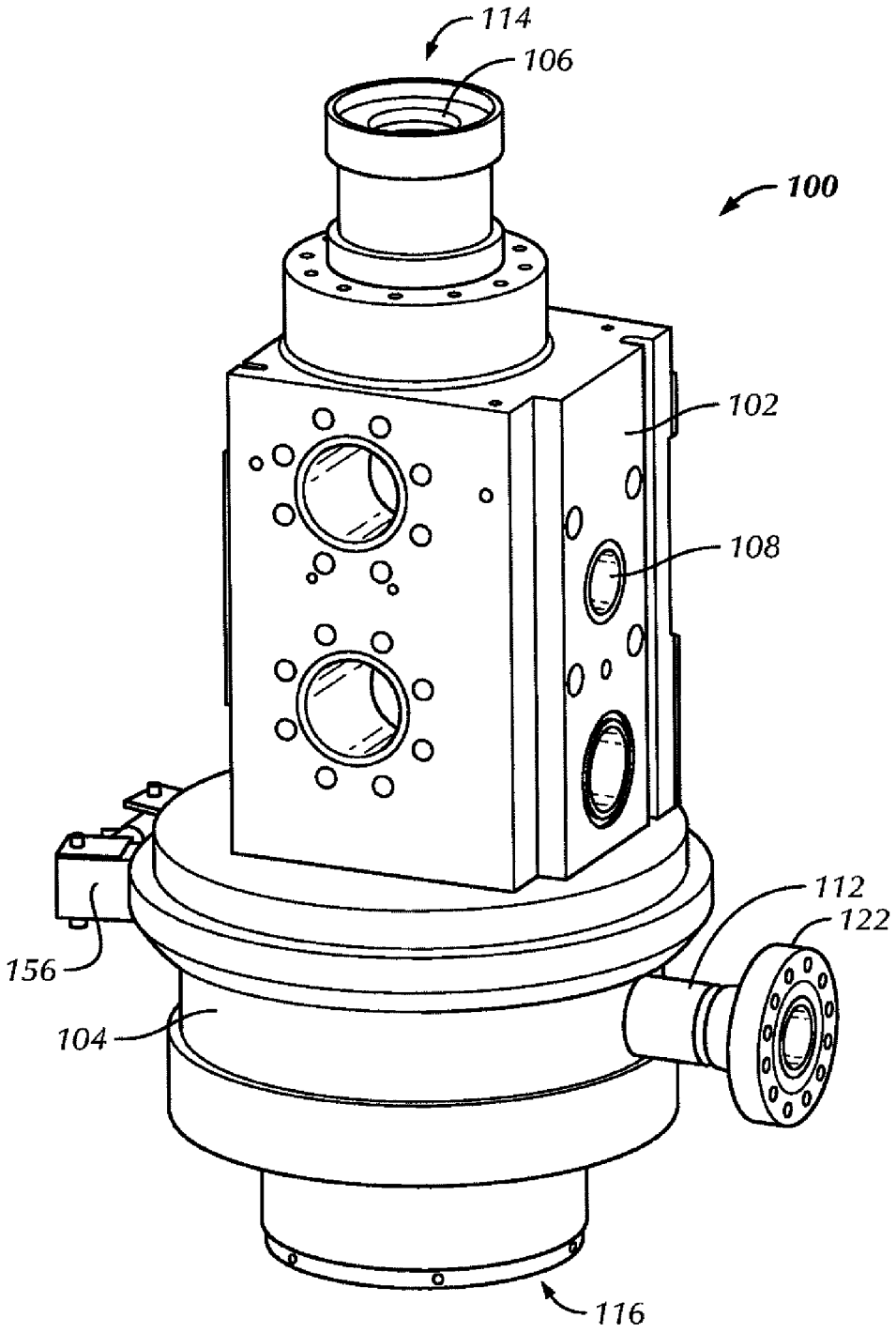
FIG. 1*a* is a perspective view of a Christmas tree in accordance with the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

In one aspect, the present disclosure relates to an adapter for use in subsea wellbore operations. The adapter may be situated on a subsea wellhead and may connect a tubing hanger within the wellhead to production equipment. The adapter may be configurable such that a connector for the production equipment may be oriented in a desired direction.

Figure 1B:
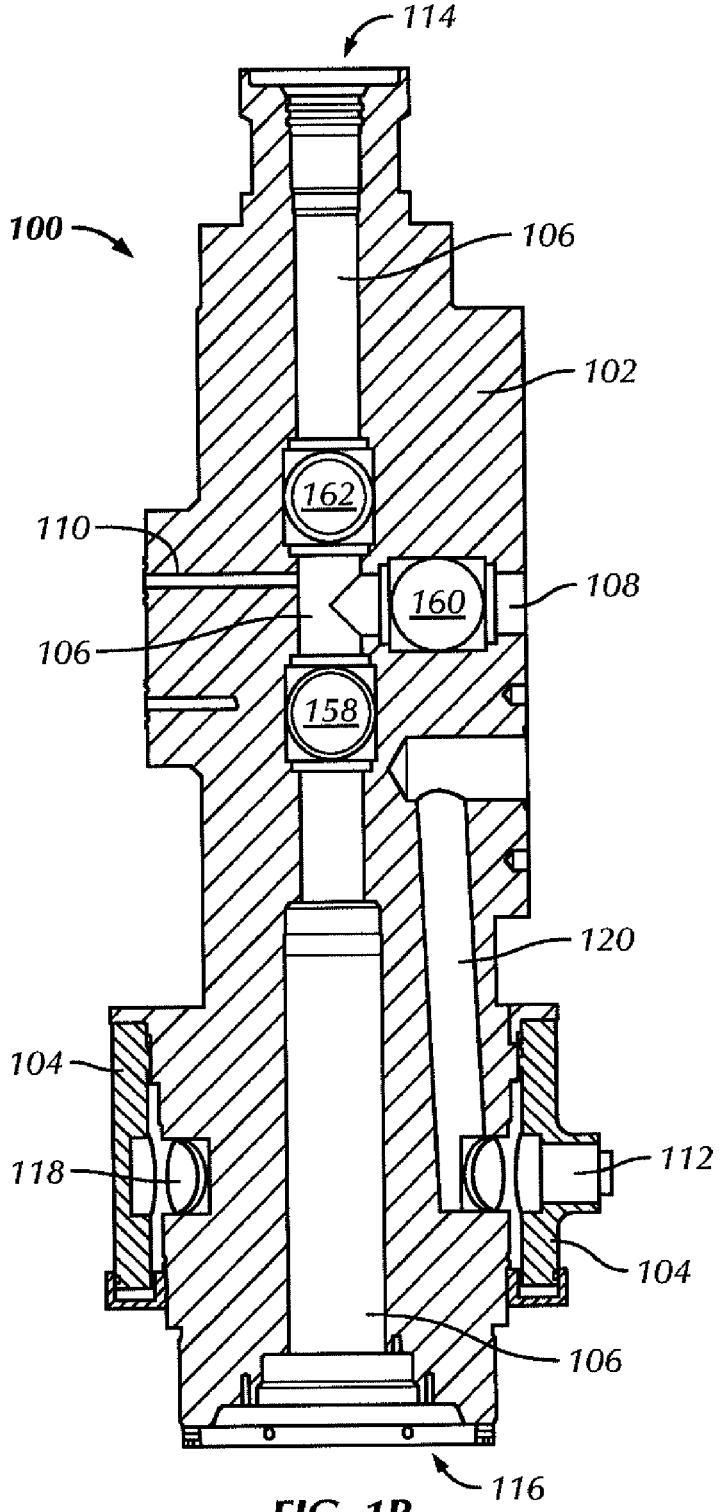
FIG. 1*b* is a cross-section view of a Christmas tree in accordance with the present disclosure.

FIGS. 1*a* and 1*b* illustrate a Christmas tree 100 according to embodiments herein, showing an external view and a cross-section view respectively. The Christmas tree 100 may include a body 102 and a sleeve 104, which may be disposed around a portion of the body 102.

The body 102 may have a proximal end 114 and a distal end 116. The body 102 may include a production flowbore 106. The production flowbore 106 may be formed approximately through the center of the body 102 and may intersect both the proximal end 114 and the distal end 116 of the body 102. The body 102 may be configured to be attached to other wellbore equipment at the distal end 116 and the proximal end 114, proximate the production flowbore 106.

The body 102 may include a longitudinal flowbore 108, which may intersect the production flowbore 106. The longitudinal flowbore 108 may be normal to the production flowbore 106. A terminal end of the longitudinal flowbore 108 may intersect the production flowbore 106. The longitudinal flowbore 108 may intersect an outer portion of the body 102.

In some embodiments, the body 102 may include one or more auxiliary pathways 110. The auxiliary pathways 110 may be annulus passageways, crossover passageways, or chemical injection passageways, or any combination thereof. A terminal end of one or more of the auxiliary pathways 110 may intersect the production flowbore 106.

A production master valve 158 and a production swab valve 162 may be disposed within the production flowbore 106 on opposite sides of the intersection of the longitudinal flowbore 108 and the production flowbore 106. A production wing valve 160 may be disposed within the longitudinal flowbore 108. The production master valve 158, the production wing valve 160, and the production swab valve 162 may be controlled to direct the flow of fluid through the Christmas tree 100.

A sleeve 104 may be disposed around the body 102 proximal the distal end 116 of the body 102. The sleeve 104 may be circumferentially rotatably attached, such that the sleeve 104 may rotate around the body or a portion thereof. An annular fluid gallery 118 may be formed between the sleeve 104 and the body 102. The annular fluid gallery may be formed, for example, by a circumferential groove around the outer perimeter of the body 102 or a portion thereof, such as extending 90°, 120° 150°, 180°, or 270° around the body 102. A seal may be formed between the sleeve 104 and the body 102, such that fluid may be contained in or transmitted through the annular fluid gallery 118. The sealing and rotation mechanisms will be discussed in more detail below. The sleeve 104 may be attached to the body 102, such that fluid at high pressures may be contained within the annular fluid gallery 118 and the Christmas tree 100 may withstand high external pressures. An attachment mechanism may be provided between the sleeve 104 and the body 102 to satisfy these requirements.

At least one of the longitudinal flowbore 108 and the auxiliary flowbores 110 may include a flowpath 120 or be configured to connect to a flowpath 120 which connects to the annular fluid gallery 118. For example, FIG. 1*b* illustrates an embodiment in which the longitudinal flowbore 108 terminates at an outer surface of the body 102. The body 102 includes a flowpath 120 which also terminates at an outer surface of the body 102. The longitudinal flowbore 108 and the flowpath 120 are configured to be connected to external equipment at their terminal ends. The external equipment may include one or more bores which may fluidly connect the longitudinal flowbore 108 to the flowpath 120. In some embodiments, the external equipment which connects the longitudinal flowbore 108 to the flowpath 120 may include a choke valve (not shown) and/or a flow meter (not shown).

In some embodiments, the longitudinal flowbore 108 and the flowpath 120 may connect at a point within the body 102. In some embodiments, an auxiliary flowbore 110 and the flowpath 120 may connect at a point within the body 102. In some embodiments, an auxiliary flowbore 110 may be configured to be connected to the flowpath 120 by external equipment. One having ordinary skill in the art may design the longitudinal flowbore 108, the auxiliary flowbores 110, and the flowpath 120 such that the production flowbore 106 is fluidly connected to the annular fluid gallery 118.

The sleeve 104 may include a transverse flowbore 112. The transverse flowbore 112 may allow the annular fluid gallery 118 to be connected to external equipment, such as a flowline (not shown), which may in turn be connected to a flowline hub (not shown). The connection between the transverse flowbore 112 and the external equipment may be able to withstand high pressures, both internal and external to the transverse flowbore 112. Rotating the sleeve 104 about the body 102 may allow the transverse flowbore 112 to be oriented in different directions. In some embodiments, as illustrated in FIG. 1*a*, a flange 122 may be attached to the transverse flowbore 112 at an outer surface of the sleeve 104. The flange 122 may facilitate attachment of the transverse flowbore 112 to external equipment. In some embodiments, a butt weld component may be attached to the transverse flowbore 112. Other means for connecting the transverse flow bore 112 to external equipment may also be used. In some embodiments, the external equipment may be a pipe (not shown) or jumper (not shown) connected to a manifold (not shown).

Figure 2:
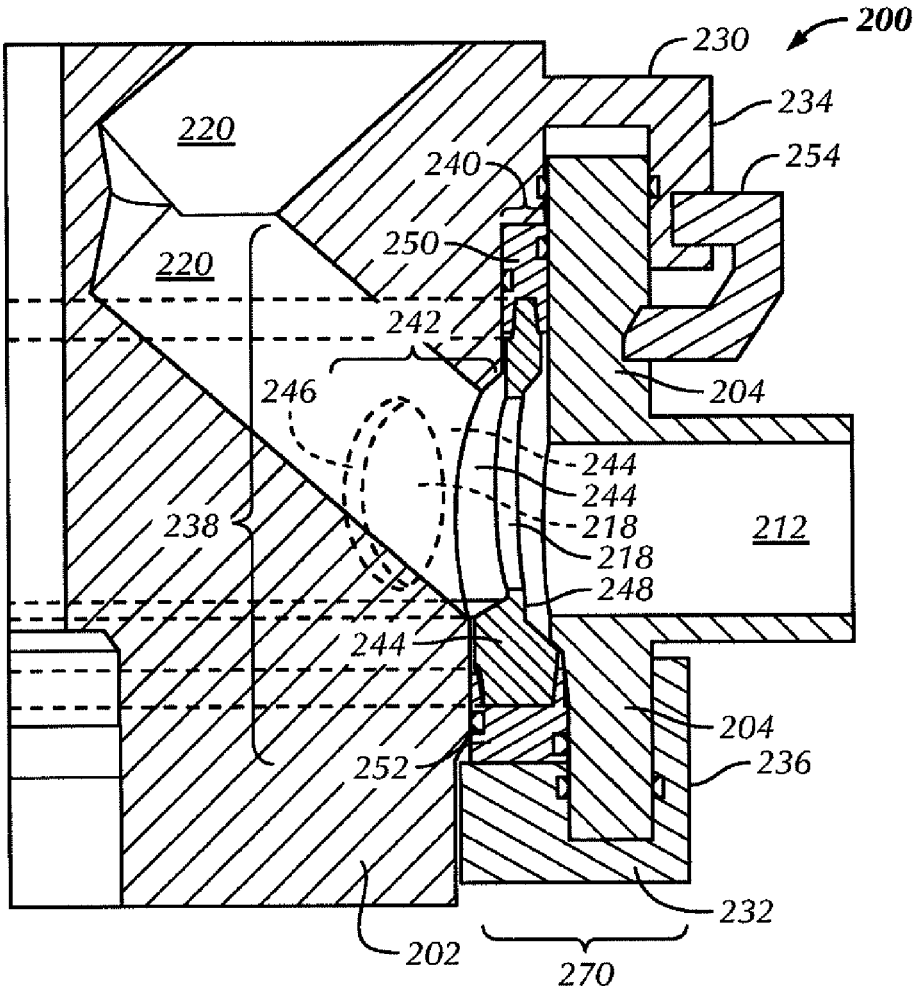
FIG. 2 is a cross-section view of a Christmas tree in accordance with the present disclosure.

FIG. 2 illustrates a cross-section view of a Christmas tree 200 showing more detail of the connection between the body 202 and the sleeve 204, and the annular production gallery 218.

The body 202 may include an upper shoulder 230. The upper shoulder 230 may protrude radially from an outer surface of the body 202, such that the upper shoulder 230 may be above the sleeve 204. The upper shoulder 230 may include an outer lip 234 which may protrude downward from the upper shoulder 230.

A retainer nut 270 may be disposed around the body 202 below the sleeve 204. The retainer nut 270 may include a lower shoulder 232 and an outer lip 236 which may protrude upward from the lower shoulder 232.

The outer lips 234, 236 may be radially external to the sleeve 204. In some embodiments, the upper shoulder 230 may be formed as part of a retainer nut 270 and the lower shoulder may be formed integrally to the body 202.

FIG. 2 illustrates a non-limiting exemplary embodiment in which the upper shoulder 230 is formed integrally to the body 202 and the lower shoulder 232 is formed by a separate retainer nut 270 which may be rigidly affixed to the body 202 through any means known in the art. In some embodiments, the lower shoulder may be formed integrally to the body and the upper shoulder may be formed by a separate retainer nut. Having one of the upper shoulder 230 and the lower shoulder 232 formed as an integral part of the body 202 and having the other of the upper shoulder 230 and the lower shoulder 232 formed by a retainer nut may allow the body 202 and the sleeve 204 to be assembled more easily. The sleeve 204 may be disposed around the body 202 proximate the integrally formed shoulder 230, 232 prior to the attachment of the separately formed shoulder 230, 232 to the body 202.

The body 202 may include an annular groove 238. The annular groove 238 may be located between the upper shoulder 230 and the lower shoulder 232 in an axial direction. The annular groove 238 may be located internal to the sleeve 204 in a radial direction. The annular groove 238 may be stepped such that an outer portion 240 has a greater height than an inner portion 242.

A production gallery cage 244 may be disposed within the annular groove 238. The production gallery cage 244 may substantially fill the inner portion 242 of the annular groove 238 and may partially fill the external portion 240 of the annular groove 238. The production gallery cage 244 may be hollow, such that an annulus 246 is formed therethrough. The production gallery 218 may be located or partially located within the annulus 246. A portion of the production gallery 218 may be located in a space 248 between the production gallery cage 244 and the sleeve 204. The production gallery cage 244 may be configured such that fluid may pass between the hollow annulus 246 and the space 248 between the production gallery cage 244 and the sleeve 204.

The Christmas tree 200 may include an upper seal assembly 250 and a lower seal assembly 252. The upper seal assembly 250 may be located within the outer portion 240 of the annular groove 238 proximal the production gallery cage 244. The lower seal assembly 252 may be located within the outer portion 240 of the annular groove 238 distal the production gallery cage 244. The upper seal assembly 250 may include a metal seal and an elastomeric back-up seal. The lower seal assembly 252 may include a metal seal and an elastomeric back-up seal. The seal assemblies 250, 252 may be designed to withstand operating pressures in the adapter using any material or combination of materials known in the art.

The upper seal assembly 250 may include arms which may surround a portion of the production gallery cage 244 on an internal side and on an external side. The lower seal assembly 252 may include arms which may surround a portion of the production gallery cage 244 on an internal side and on an external side. The production gallery cage 244 may maintain the upper seal assembly 250 and the lower seal assembly 252 in desired positions during assembly of Christmas tree 200.

In some embodiments, such as the embodiment illustrated in FIG. 2, the width of the upper seal assembly 250 may be less than the width of the lower seal assembly 252. In some embodiments, the width of the upper seal assembly 250 may be the same as or greater than the width of the lower seal assembly 252. In some embodiments, such as the embodiment illustrated in FIG. 2, the height of the upper seal assembly 250 may be greater than the height of the lower seal assembly 252. In some embodiments, the height of the upper seal assembly 250 may be equal to or less than the height of the lower seal assembly 252.

As discussed above, the sleeve 204 may be circumferentially rotatably attached to the body 202, such that it may rotate about the body 202. The materials of the sleeve 204, body 202, and seal assemblies 250, 252 may be selected such that the sleeve 204 may rotate about the body 202 without damage to the seal assemblies 250, 252. Clearances may be formed between the sleeve 204 and the upper shoulder 230, between the sleeve 204 and the lower shoulder 232, the sleeve 204 and the upper outer lip 234, the sleeve 204 and the lower outer lip 236, the sleeve 204 and the upper seal assembly 250, and/or the sleeve 204 and the lower seal assembly 252. An adapter may include clearances at all of the interfaces listed above, at none of the interfaces listed above, or at some subset of the interfaces listed above.

The sleeve 204 may be able to rotate three hundred sixty degrees around the body 202 or the sleeve 204 may be able to rotate through some range less than three hundred sixty degrees. In some embodiments, the sleeve 204 may be able to rotate between twenty degrees and three hundred degrees. In some embodiments, the sleeve may be able to rotate between one hundred and two hundred fifty degrees. In some embodiments, the sleeve 204 may be able to rotate between one hundred twenty and two hundred twenty degrees. Having a greater range of rotation may allow the Christmas tree 200 to be placed in a greater number of configurations, and may allow more flexibility in reconfiguring the Christmas tree 200 subsea. Having a smaller range of rotation may allow the annular fluid gallery 218 to be less than three hundred sixty degrees. Reducing the extent of the annular fluid gallery 218 may reduce the difficulty of engineering or risk of failure of a Christmas tree 200 for a high pressure environment.

The Christmas tree 200 may include a lock ring 254. The lock ring 254 may be disposed around the body 202 and the sleeve 204. The lock ring 254 may engage with the outer lip 234 of the upper shoulder 230 and a proximal portion of the sleeve 204. The lock ring 254 may be movable between a disengaged (unlocked) configuration which may allow the sleeve 204 to rotate relative to the body 202 and an engaged (locked) configuration which may prevent the sleeve 204 from rotating relative to the body 202. In some embodiments, the lock ring 254 may engage with the outer lip 236 of the lower shoulder 232 and a distal portion of the sleeve 204. The lock ring 254 may include a lock ring expander 156, shown in FIG. 1*a*. The lock ring expander 156 may expand the diameter of the lock ring 254 from an engaged configuration to a disengaged configuration. The lock ring expander 156 may expand by any means known in the art, including mechanical means or hydraulic means. The orientation of the sleeve 204 may be secured when the lock ring 254 is engaged.

With reference to FIG. 1, some embodiments of the Christmas tree 100 may not include a production master valve 158, a production swab valve 162, a production wing valve 160, or other valves or associated bores. The Christmas tree 100 may be connected to a valve block (not shown) which may be deployed separately from the Christmas tree 100.

Figure 3:
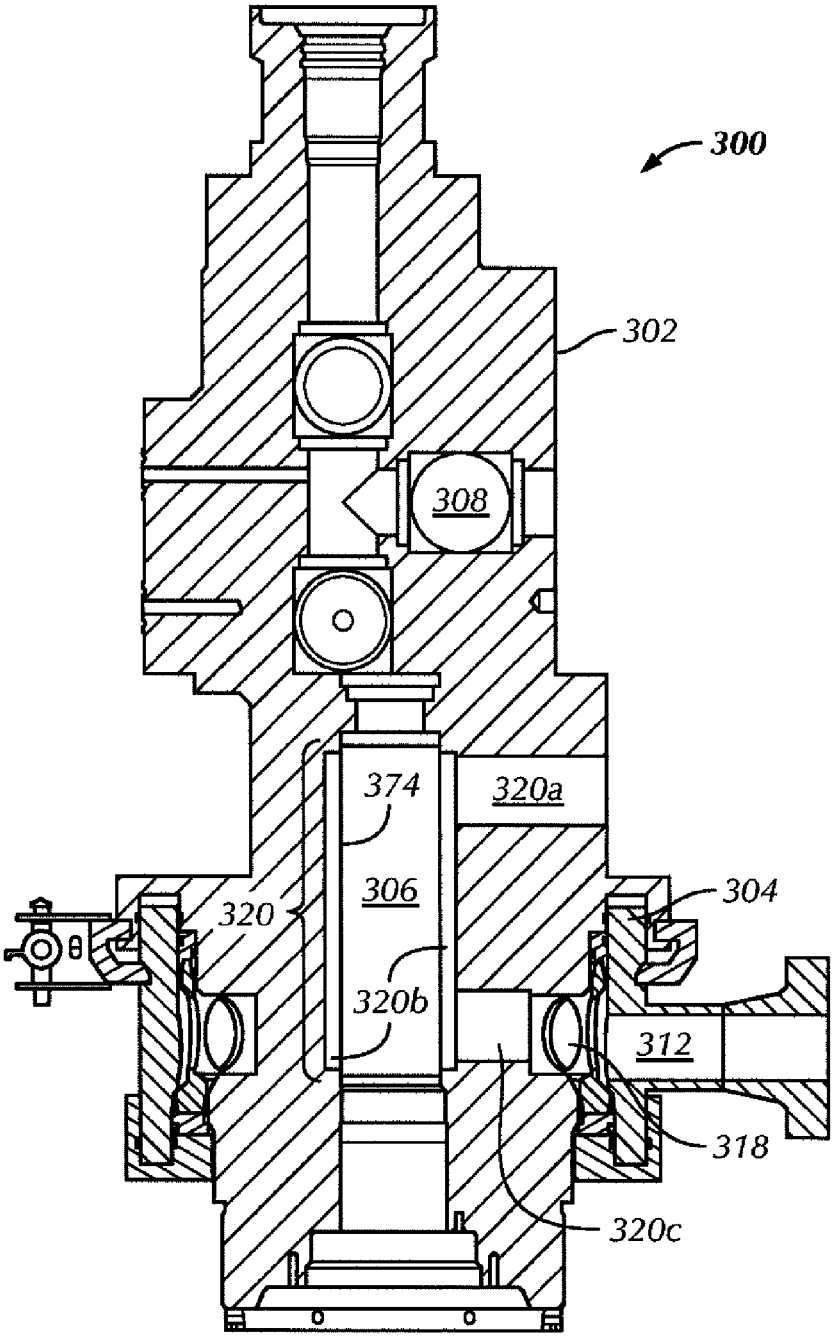
FIG. 3 is a cross-section view of a Christmas tree in accordance with the present disclosure.

FIG. 3 illustrates an embodiment of a Christmas tree 300. The Christmas tree 300 includes a body 302 having a production flowbore 306 and a longitudinal flowbore 308 and a sleeve 304 having a transverse flowbore 312. An annular fluid gallery 318 is formed between the sleeve 304 and the body 302. The longitudinal flowbore 308 may be configured to be connected, via external equipment, to a flowpath 320 which connects to the annular fluid gallery. The flowpath 320 may include a first flowbore 320*a*, a flow gallery 320*b*, and a second flowbore 320*c*. The flow gallery 320*b* may be formed around the production flowbore 306. The flow gallery 320*b* may be separated from the production flowbore 306 by a production isolation insert 374. The first flowbore 320*a* may connect an external surface of the body 302 to the flow gallery 320*b*. The second flowbore 320*c* may connect the flow gallery 320*b* to the annular fluid gallery 318.

Figure 4:
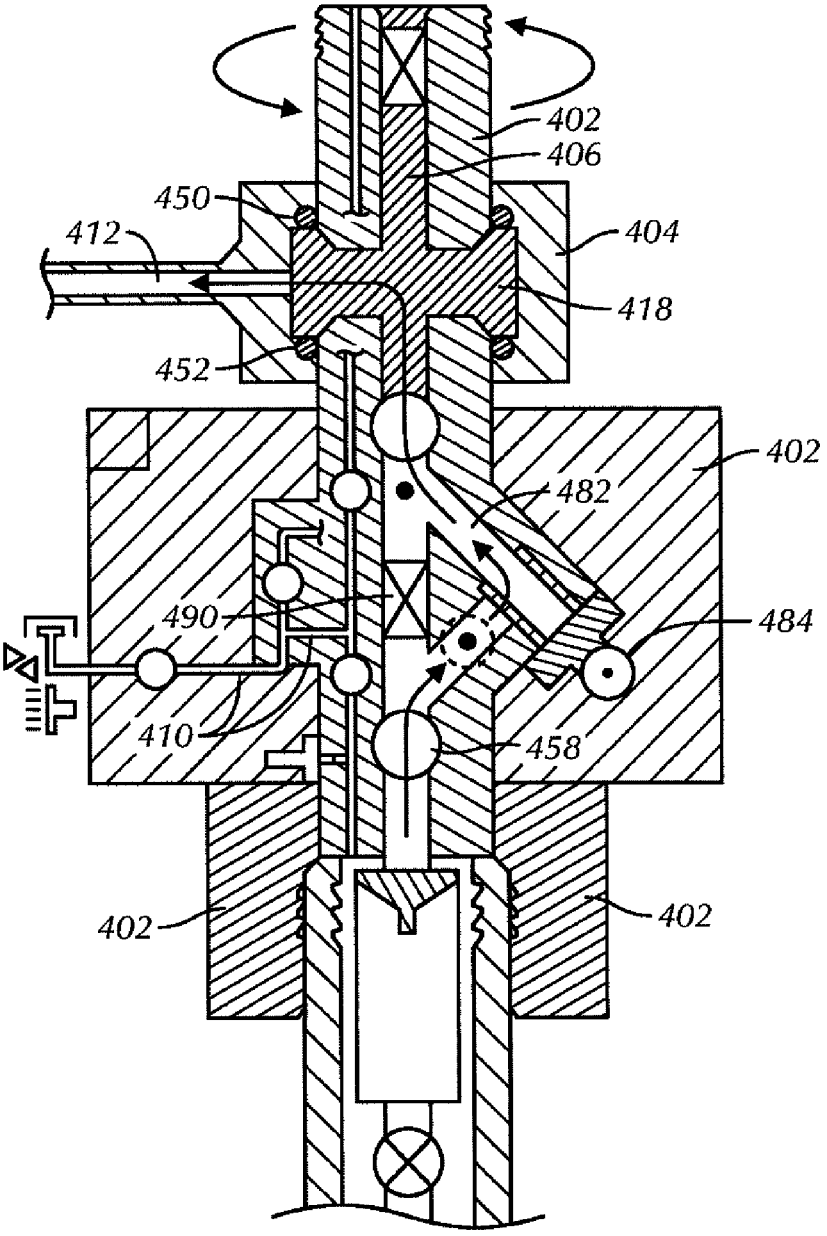
FIG. 4 is a cross-section view of a Christmas tree in accordance with the present disclosure.

FIG. 4 illustrates an embodiment of a Christmas tree 400. The Christmas tree 400 includes a body 402 and a sleeve 404, which may be circumferentially rotatable about the body 402. The body 402 may include a production flowbore 406, a diversion flowbore 482, and one or more auxiliary pathways 410. The diversion flowbore 482 may be an angled bore having two terminal ends that intersect the production flowbore 406. The auxiliary pathways 410 may be annulus passageways, crossover passageways, or chemical injection passageways, or any combination thereof. A terminal end of one or more of the auxiliary pathways 410 may intersect the production flowbore 406. The sleeve 404 may include a transverse flowbore 412. The Christmas tree 400 may include an upper seal assembly 450 and a lower seal assembly 452 disposed between the body 402 and an inner portion of the sleeve 404.

An annular fluid gallery 418 may be formed between the sleeve 404 and the body 402. The sleeve 404 may be disposed around an upper portion of the body 402, above a master valve block 480. The production flowbore 406 may pass through the master valve block 480. A production master valve 458 may be disposed in the production flowbore 406 within the master valve block 480. The production master valve 458 may control the flow of fluid through the production flowbore 406 and the diversion flowbore 482. The diversion flowbore 482 may include an outlet 484. The master valve block 480 may include additional valves which may control the flow of fluid through the production flowbore 406, the diversion bore 482, and the one or more auxiliary pathways 410. The diversion flowbore 482 may intersect the production flowbore 406 above and below a valve 490 of the master valve block 480. In some embodiments, an isolation barrier, a diverter, a plug, or other element which temporarily prevents flow through flowbore 406 and serves as a pressure barrier may be used in place of the valve 490.

In some embodiments, the master valve block 480 may include an integral choke valve. In some embodiments, the choke valve may be separate from the master valve block 480.

Any features described with respect to FIGS. 1-3 may also be included in the embodiment of the Christmas tree 400 described with respect to FIG. 4. The Christmas tree 400 may allow wellbore interventions to be performed without disconnecting the transverse flowbore 412 of the sleeve 404 from external equipment, such as a flowline or a jumper (not shown).

In another aspect, the present disclosure relates to a system of subsea wellbore equipment including a Christmas tree, such as a Christmas tree 100, 200, 300, or 400 described above. The system may be used for the production of subsea hydrocarbons, such as oil or natural gas.

Referring again to FIG. 1, the Christmas tree 100 may be situated on a subsea wellhead (not shown). The distal end 116 of the body 102 may be connected to the wellhead using any means known in the art, such as bolting, welding, or a combination of techniques. The production flowbore 106 may be aligned with a flowbore (not shown) of the wellhead, such that the production flowbore 106 and the wellhead flowbore are coaxial. The wellhead flowbore may be connected directly or indirectly to the production flowbore 106 of the Christmas tree 100. A tubing hanger (not shown) may be disposed within the Christmas tree 100 or the proximal end of the wellhead flowbore. The tubing hanger may extend into the distal end of the production flowbore 106.

Wellbore equipment may be connected to the proximal end 114 of the body 102. For example, additional components of the subsea Christmas tree (not shown) may be connected to the proximal end 114 of the body 102. The Christmas tree may be a horizontal Christmas tree or a vertical Christmas tree. A control valve body (not shown) may be connected directly or indirectly to the proximal end 114 of the body 102.

As discussed above, external equipment (not shown) may be connected to the longitudinal flowbore 108 and the flowpath 120. The external equipment may include one or more bores which may connect the longitudinal flowbore 108 to the flowpath 120. In some embodiments, the external equipment may include a choke valve disposed in one of the connecting bores. In some embodiments, the external equipment may include a control valve body. The control valve body may be based on top-flow geometry. In some embodiments, the external equipment may include an IRSC flange.

The transverse flowbore 112 of the sleeve 104 may be connected to production equipment (not shown). In some embodiments, the production equipment may be a flowline hub (not shown). The transverse flowbore 112 may be connected to the equipment via a flowline or a flow loop (not shown), which may be rigid or flexible. The transverse flowbore 112 may be connected to the flowline or flow loop via a flange 122 or a butt weld component.

Components of a subsea Christmas tree may be able to be installed on top of the Christmas tree 100 without disconnecting the transverse flowbore 112 from the flowline. Wellbore interventions may be able to be performed without disconnecting the transverse flowbore 112 from the flowline. The location of the sleeve 104 and the transverse flowbore 112 near the base of the Christmas tree 100 may improve the ease with which installations and interventions may be performed without disconnecting a flowline from the Christmas tree 100.

In another aspect, the present disclosure relates to a method of installing production equipment on a subsea wellhead using a Christmas tree 200. Components which are not part of the adapter may not be illustrated in this disclosure.

The Christmas tree 200 may be transported to a sea surface location proximate a subsea wellhead using a drilling rig or other vessel. During transport, the sleeve 204 may be maintained in a configuration such that the upper seal assembly 250 and lower seal assembly 252 do not engage to form a seal between the sleeve 204 and the body 202. An additional transportation fixture (not shown) may be installed on the Christmas tree 200 to prevent engagement of the seal assemblies 250, 252. The transportation fixture may allow the Christmas tree 200 reduce or eliminate the need for the Christmas tree 200 to be transported with a pressurized soft land.

A tubing hanger may be installed in the proximal end of a subsea wellhead. The tubing hanger may include a fine alignment slot or other orientation feature. The orientation of the fine alignment slot may be identified by thru-wall sensing, such as acoustic or electromagnetic imaging, or may be identified by any means known in the art. The heading of the tubing hanger may be determined by a remote operated vehicle and may be communicated to personnel on a drilling rig or vessel. The position of production equipment, such as a flowline hub, to which it is desired to connect the Christmas tree 200 may also be known to or determined by the personnel.

Prior to deployment of the Christmas tree 200, the sleeve 204 and seal assemblies 250, 252 may be pressurized with a soft land to prevent engagement of the seal assemblies 250, 252. Personnel may rotate the sleeve 204 of the Christmas tree 200 into a desired configuration based on the known configuration of the tubing hanger and the known location of the production equipment.

The sleeve 204 may be locked in the desired location using the lock ring 254. Personnel may orient a flow loop for deployment and/or attach the flow loop to the Christmas tree 200. The transportation fixture may be removed when the sleeve 204 is in the desired orientation. The seal assemblies 250, 252 may be engaged. In some embodiments, the seal assemblies 250, 252 may be engaged by venting the soft land. The lock ring 254 may be locked, such that the lock ring 254 prevents rotation of the sleeve 204. The Christmas tree 200 may be pressure tested to confirm the seal assemblies 250, 252 have engaged fully.

The Christmas tree 200 may be deployed to the subsea wellhead. The Christmas tree 200 may be maintained in a desired orientation during deployment, such that when the Christmas tree 200 is landed on the wellhead, the orientation of the Christmas tree 200 is known. The Christmas tree 200 may be oriented on the wellhead through engagement with the fine alignment slot or other orientation feature of the tubing hanger. In some embodiments, the Christmas tree 200 may be landed on a wellhead adapter spool (not shown) disposed on the wellhead. The Christmas tree may be aligned with an orientation feature of the wellhead adapter spool. Other valves and connections within the Christmas tree 200 may be tested. Other subsea wellhead components may be deployed, landed on or around the Christmas tree 200, and connected to the Christmas tree 200.

In some embodiments, the sleeve 204 may be oriented after the Christmas tree 200 is landed on the wellhead, instead of prior to deployment of the Christmas tree 200.

The Christmas tree, system, and method disclosed herein may allow a tubing hanger and a Christmas tree to be installed on a subsea wellhead, without either the tubing hanger or the Christmas tree needing to be oriented after being deployed subsea. This may reduce the need for remotely operated vehicles or other equipment to determine the orientation of equipment during orientation operations. It may further prevent errors in orientation or damage to equipment during orientation operations by allowing orientation operations to be performed when personnel may directly see the equipment. It may allow the orientation of equipment which has been installed in a subsea environment to be known more accurately. The adapter, system, and method disclosed herein may allow a Christmas tree to be installed and wellbore interventions to be performed without disconnecting the adapter from a flowline connecting it to external equipment.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A Christmas tree comprising:
a body comprising:
a production flowbore therethrough;
a longitudinal flowbore intersecting the production flowbore; and
one or more annulus passageways, or crossover passageways, or chemical injection passageways intersecting at least one of the production flowbore and the longitudinal flowbore;
a sleeve attached to and circumferentially rotatable about at least a portion of the body, the sleeve including a transverse flowbore therethrough;
an annular fluid gallery formed between the body and the sleeve;
wherein at least one of the longitudinal flowbore and the one or more annulus passageways, or the crossover passageways, or the chemical injection passageways comprises a flowpath connecting to the annular fluid gallery or is configured to be connected to a flowpath connecting to the annular fluid gallery.

2. The Christmas tree of claim 1, wherein the body further comprises an upper shoulder including an outer lip.

3. The Christmas tree of claim 2, further comprising a retainer nut comprising a lower shoulder including an outer lip, and wherein the sleeve is disposed between the upper shoulder and the lower shoulder, internally to the outer lips.

4. The Christmas tree of claim 1, wherein the annular fluid gallery comprises a circumferential groove formed on an outer portion of the body.

5. The Christmas tree of claim 1, further comprising at least one seal assembly disposed between the sleeve and the body.

6. The Christmas tree of claim 5, wherein the at least one seal assembly comprises one or more metal seals, one or more elastomer seals, or any combination of metal seals and elastomer seals.

7. The Christmas tree of claim 5, further comprising a gallery cage configured to maintain a position of the at least one seal assembly.

8. The Christmas tree of claim 5, comprising an upper seal assembly disposed between the sleeve and the body proximal to the annular fluid gallery and a lower seal assembly disposed between the sleeve and the body distal to the annular fluid gallery.

9. The Christmas tree of claim 1, further comprising a lock ring expander and a lock ring, the lock ring expandable from an engaged configuration configured to prevent the sleeve from rotating relative to the body to a disengaged position configured to allow the sleeve to rotate relative to the body.

10. The Christmas tree of claim 1, wherein the sleeve is configured to rotate 360 degrees.

11. An assembly comprising:
a wellhead having a central bore; and
a Christmas tree connected to the wellhead, the Christmas tree comprising:
a body comprising:
a production flowbore therethrough;
a longitudinal flowbore intersecting the production flowbore; and
one or more annulus passageways, or crossover passageways, or chemical injection passageways intersecting at least one of the production flowbore and the longitudinal flowbore;
a sleeve attached to and circumferentially rotatable about at least a portion of the body, the sleeve including a transverse flowbore therethrough;
an annular fluid gallery formed between the body and the sleeve;
wherein at least one of the longitudinal flowbore and the one or more annulus passageways, or the crossover passageways, or the chemical injection passageways comprises a flowpath connecting to the annular fluid gallery or is configured to be connected to a flowpath connecting to the annular fluid gallery.

12. The assembly of claim 11, further comprising at least one subsea wellhead component connected to the production flowbore or the longitudinal flowbore of the Christmas tree.

13. The assembly of claim 11, further comprising a tubing hanger disposed within the central bore of the wellhead or a wellhead adapter spool and the production flowbore of the Christmas tree.

14. The assembly of claim 11, further comprising a flowline or a flow loop attached to the transverse flowbore.

15. A method of installing a Christmas tree on a wellhead, the method comprising:
configuring a sleeve of the Christmas tree to have an orientation, wherein the sleeve is attached to and circumferentially rotatable about at least an outer portion of a body of the Christmas tree, wherein the configuring comprises:
pressurizing one or more seal assemblies of the Christmas tree;
rotating the sleeve to the desired orientation;
engaging the one or more seal assemblies of the Christmas tree; and
locking the sleeve in the desired orientation;
deploying the Christmas tree to the wellhead; and
connecting the Christmas tree to the wellhead.

16. The method of claim 15, further comprising determining an orientation of a tubing hanger installed in the wellhead and determining a location of production equipment relative to the wellhead, wherein the configuring is based on the orientation of the tubing hanger and the location of the production equipment.

17. The method of claim 15, further comprising preventing engagement of one or more seal assemblies of the Christmas tree during transportation.

18. The method of claim 15, further comprising installing at least one subsea wellhead component proximate the Christmas tree.

* * * * *